US005126922A

United States Patent [19]

Andreasen

[11] Patent Number: 5,126,922

[45] Date of Patent: Jun. 30, 1992

[54] ILLUMINATED UMBRELLA OR PARASOL

[76] Inventor: Ib R. Andreasen, Vestervigvej 15, DK-2720 Vanløse, Denmark

[21] Appl. No.: 687,899

[22] PCT Filed: Dec. 4, 1989

[86] PCT No.: PCT/DK89/00287

§ 371 Date: Jun. 4, 1991

§ 102(e) Date: Jun. 4, 1991

[87] PCT Pub. No.: WO90/06069

PCT Pub. Date: Jun. 14, 1990

[30] Foreign Application Priority Data

Dec. 5, 1988 [DK] Denmark ..... 6766/88

[51] Int. Cl.[5] ..... F21V 7/04

[52] U.S. Cl. ..... 362/32; 362/102

[58] Field of Search ..... 362/32, 102

[56] References Cited

U.S. PATENT DOCUMENTS 3,275,815 9/1963 Petroff et al. .

4,099,535 7/1978 Hubachek .

FOREIGN PATENT DOCUMENTS 2477388 9/1982 France .

2628950 9/1989 France .

*Primary Examiner*—Carroll B. Dority

*Attorney, Agent, or Firm*—Larson and Taylor

[57] ABSTRACT

An illuminated umbrella or parasol (1) is described, in which there are two coaxial light conductors (not shown) within the umbrella stick (2). The inner light conductor supplies light to the central region of the cover (3), to a number of further light conductors in the ribs (4) terminated by light-spreading rib caps (11), and to a lightspreading top spike (12), while the outer light conductor supplies light to the peripheral region of the cover (3). Emphasis on the illumination may be switched between the two coaxial light conductors by means of optical means (not shown) in the handle (7), controlled by a manually slideable button (36), said handle (7) also containing the requisite batteries, a light light bulb and a lens and/or a reflector (not shown), the switching e.g. being achieved by altering the position of the bulb.

10 Claims, 4 Drawing Sheets

ILLUMINATED UMBRELLA OR PARASOL

TECHNICAL FIELD

The present invention relates to an umbrella or a parasol of the kind set forth in the preamble of claim 1.

BACKGROUND ART

U.S. Pat. No. 3,275,815 describes umbrellas or parasols of this kind, in which the inside of the cover is illuminated by means of a single light-spreading device, the latter being supplied with light through a light conductor leading from the source of light, usually a battery-powered electric bulb situated in or near the handle of the umbrella or parasol. The use of a single light-spreading device has, however, proved insufficient to provide a reasonably uniform illumination of the whole of the inside of the cover.

DISCLOSURE OF THE INVENTION

It is the object of the present invention to provide an umbrella or a parasol of the kind referred to above, in which it is possible to obtain a more uniform illumination of the inside of the cover than previously possible, and this object is achieved with an umbrella or a parasol, according to the present invention further exhibiting the features set forth in the characterizing clause of the claim 1. With this arrangement, the inside of the cover is illuminated by two mutually independent light-spreading devices, making it substantially easier to provide a uniform illumination of the inside of the cover.

Advantageous embodiments of the umbrella or parasol according to the present invention, the effects of which are explained in the following detailed portion of the present specification, are set forth in claims 2–10.

BRIEF DESCRIPTION OF THE DRAWINGS

In the following detailed specification the present invention is explained with reference to the drawings in which.

DESCRIPTION OF THE PREFERRED EMBODIMENT

Figure 1:
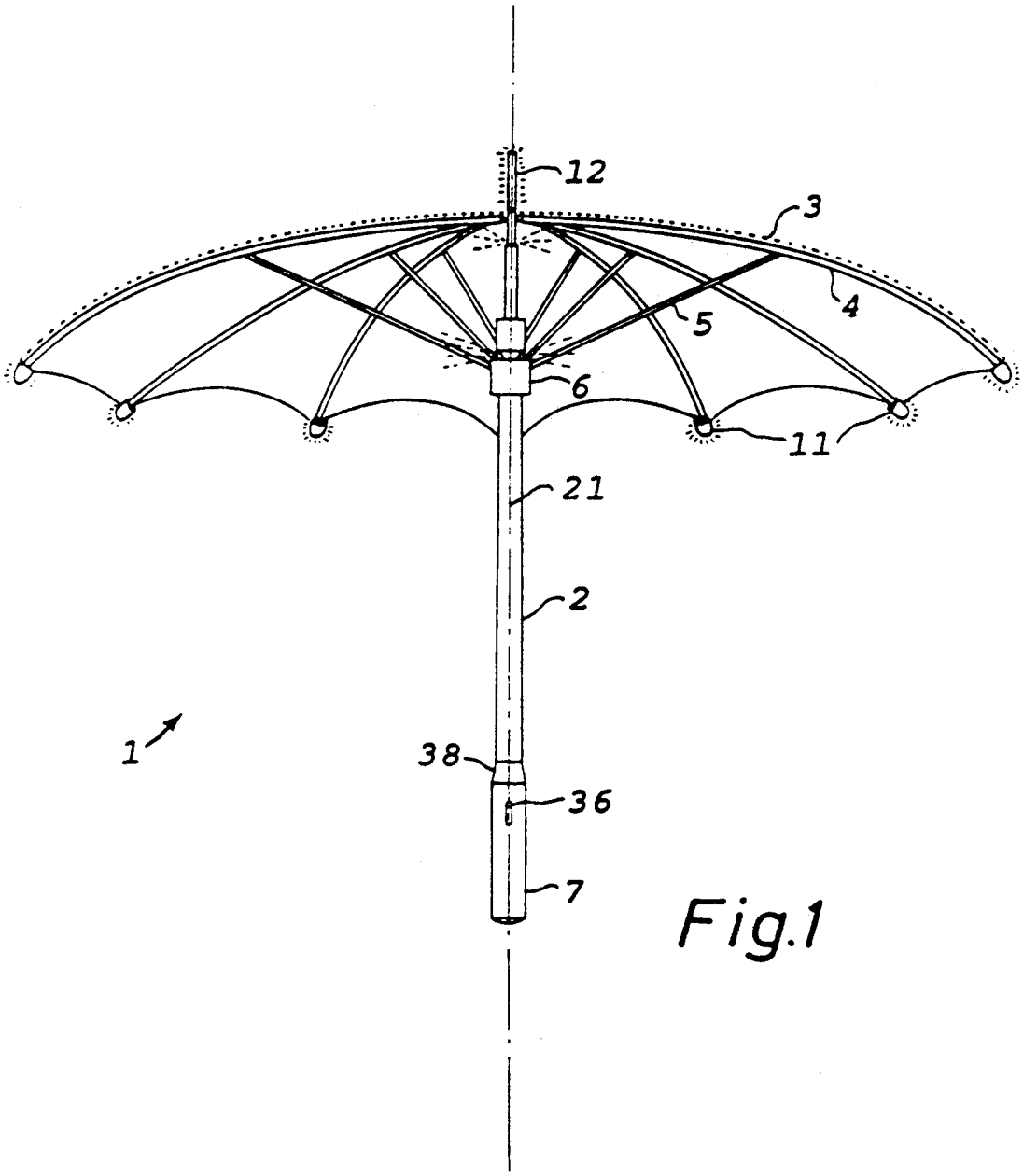
FIG. 1 is an overall view of an exemplary embodiment of an illuminated umbrella according to the present invention, shown in elevation and partly in section.

The umbrella 1 shown in FIG. 1 comprises in the usual manner an umbrella stick 2 and a cover 3, the latter being held in the open position shown by a number of ribs 4 supported by struts 5 on a slide 6, with which the cover 3 may be collapsed in the usual manner by moving the slide 6 towards the handle 7.

Figure 5:
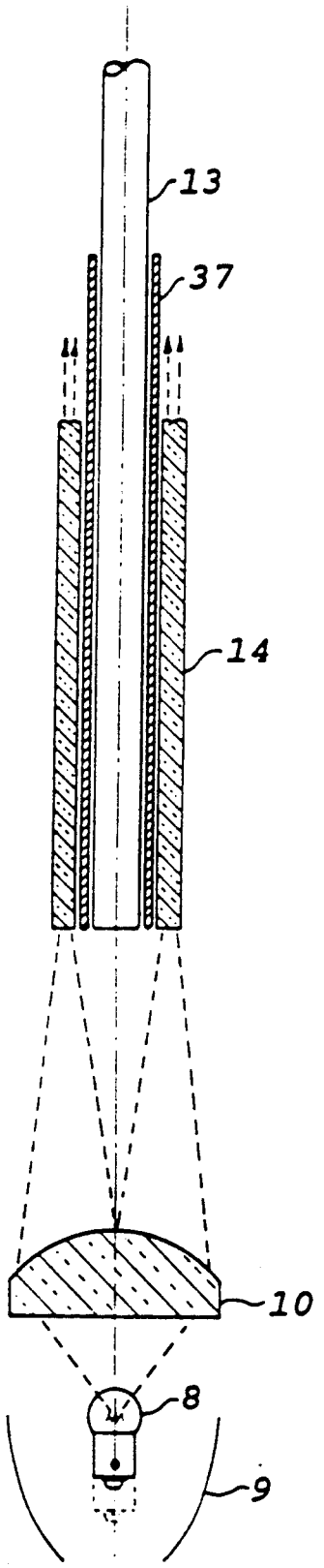
FIGS. 5 and 6 are diagrammatic vertical sectional views showing the lower ends of the light conductors and the light source with the latters electric light bulb in two different positions.
Figure 6:
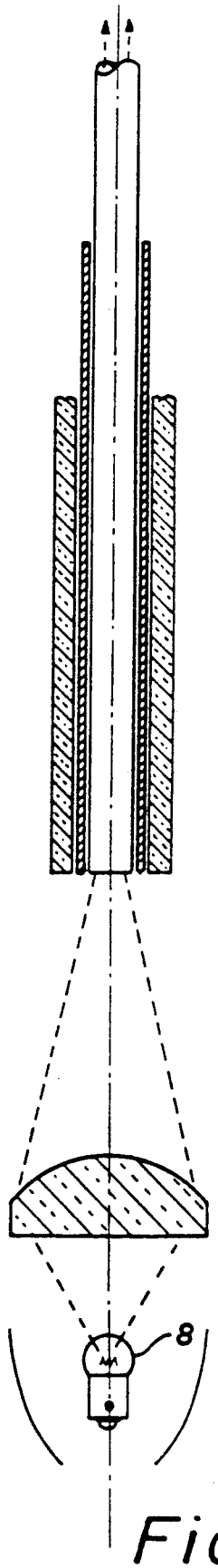

In the exemplary embodiment of an umbrella according to the present invention shown in FIG. 1, the handle 7 comprises a battery (not shown), an electric light bulb 8, a reflector 9 and a lens 10, the latter three items being shown in FIGS. 5 and 6.

The exemplary embodiment shown in FIG. 1 also comprises various optical means to be described below, with which

- light may be projected onto the inside of the cover 3 in the central and peripheral regions thereof,
- light may be conducted through the ribs 4 to a number of light-spreading rib caps 11, and
- light may be conducted to a light-spreading top spike 12.

Figure 2:
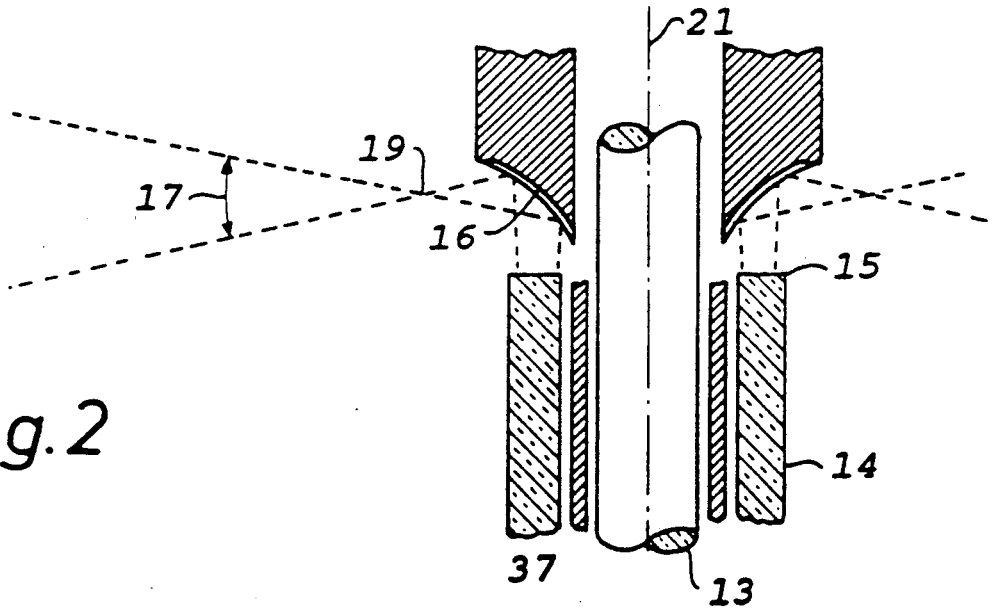
FIG. 2 is a vertical sectional view showing the transition region between the outer light conductor and the associated reflecting surfaces.

As may be seen especially from FIGS. 2, 5 and 6, the umbrella according to the present invention comprises an inner light conductor 13, and coaxial therewith an outer light conductor 14.

The output end 15 of the outer light conductor 14 is adapted to emit light towards a number of concave reflecting surfaces 16 adapted to reflect the light from said output end 15 towards the non-central regions of the umbrella cover 3. In order to make the angle 17, through which the light is distributed in the vertical direction (i.e. parallel to the stick 2), smaller than the angle 18, through which the light is distributed in the peripheral direction, so as to ensure a reasonably uniform illumination of the cover 3 with a minimum of light lost below its edge, the concave reflecting surfaces are shaped with a dual curvature, making them "astigmatic". By comparing FIGS. 2 and 3, it will be seen that this astigmatism produces two focal points, i.e. a "vertical" focal point 19 and a "horizontal" focal point 20, the latter being markedly closer to the common optical axis 21 than the former.

Figure 3:
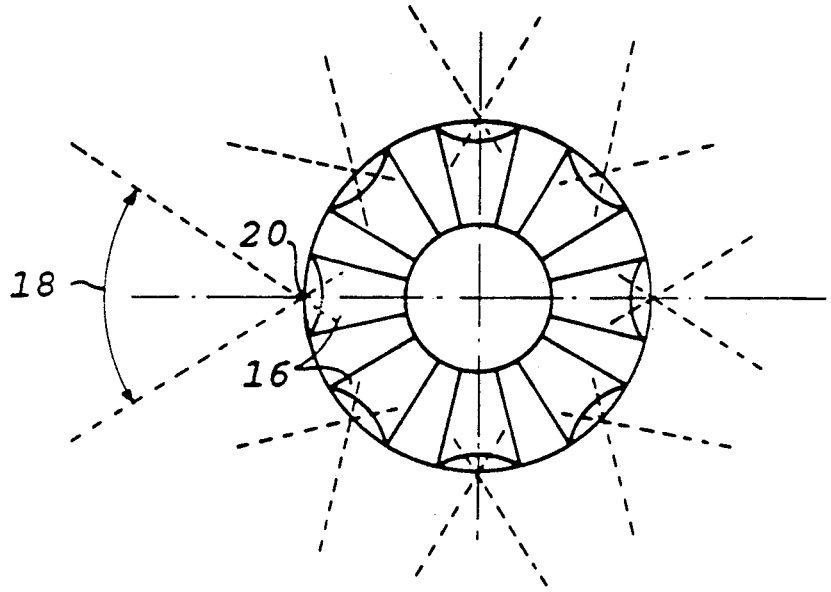
FIG. 3 shows the reflecting surfaces shown in FIG. 2 as viewed from below.
Figures 4, 4A:
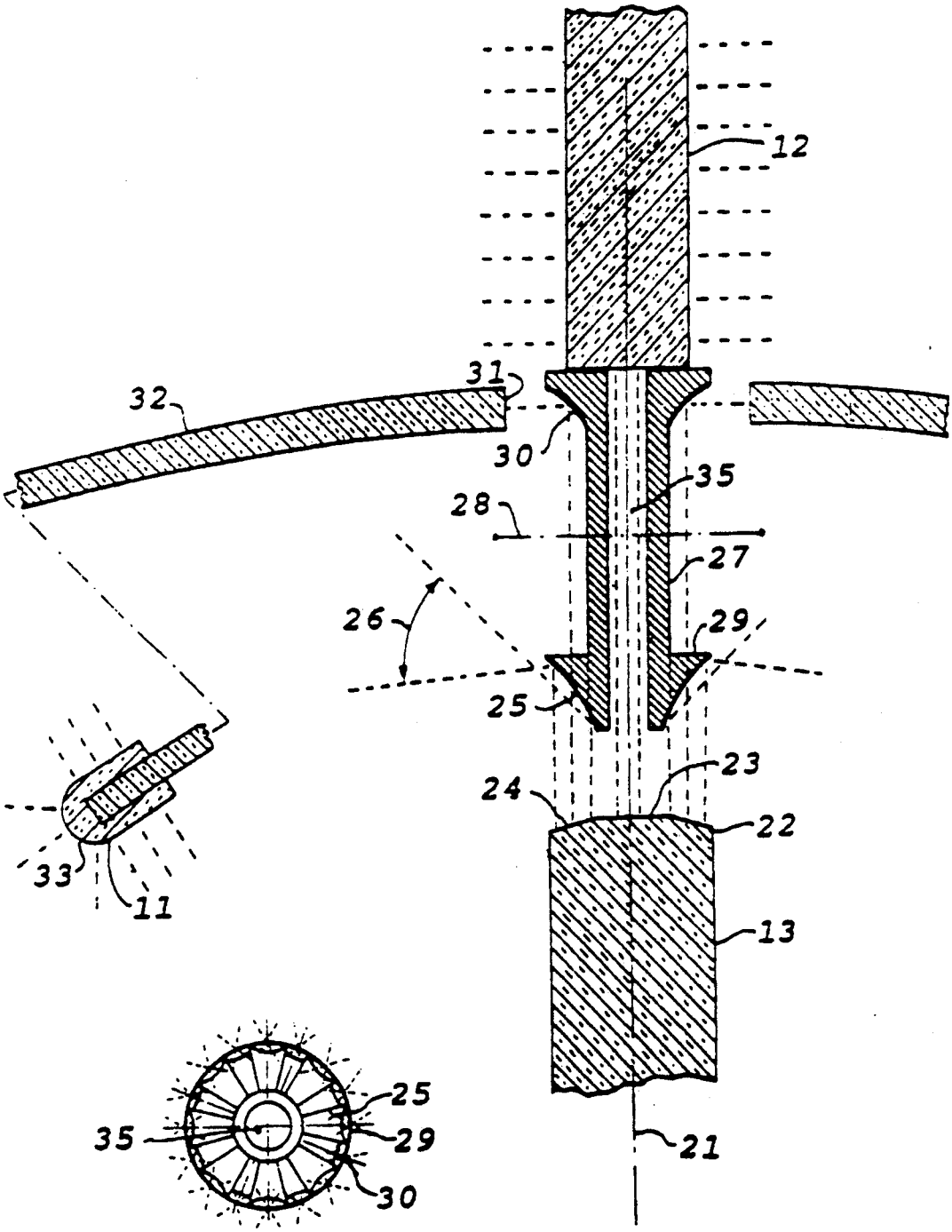
FIG. 4 is a vertical sectional view showing the transition region between the inner light conductor, the reflecting surfaces associated therewith and further means supplied with light from these reflecting surfaces.
FIG. 4*a* shows the member according to FIG. 4 carrying the light-reflecting surfaces, viewed from below.

While the outer light conductor 14 terminates with its output end 15 roughly at the same level as the top of the slide 6 in its top position shown in FIG. 1, the inner light conductor 13 continues upwards to a point considerably closer to the top of the cover 3, where it is terminated by an output end 22, the latter in the exemplary embodiment shown being composed of a central plane portion 23 and a peripheral frusto-conical portion 24 (please note, that the scale of FIG. 4 is twice that of FIGS. 2 and 3, the scale of the two latter again being twice that of FIGS. 5 and 6). The light emanating from the peripheral surface 24 is reflected by a number of concave reflecting surfaces 25, thus being spread outwardly and upwardly and distributed through a "vertical" angle 26 to illuminate the central region of the cover 3 shown in FIG. 1.

At this point it should be noted that the hollow member 27, on which the concave reflecting surface 25 are formed, is shown in FIG. 4 with its upper and lower portions lying above and below a horizontal plane 28 respectively mutually rotated through a small angle about the optical axis 21 for reasons which will appear below.

The concave reflecting surfaces 25 are formed on a number of "teeth" 29. As may be seen when viewing FIG. 4*a* in conjunction with FIG. 4, the interstices between adjacent teeth 29 permit some of the light from the output end 22 to reach a further set of concave reflecting surfaces 30 formed on the upper end of said hollow member 27 and adapted to reflect this light into the input ends 31 of a number of light conductors 32, the output ends 33 of which are surrounded by end caps 11 of transparent or translucent material capable of spreading the light received from the output ends 33. The light conductors 32 are preferably adapted to extend alongside or inside the umbrella ribs 4 shown in FIG. 1, the end caps 11 in the latter case also constituting the rib caps adapted in the usual manner (not shown) to fasten the cover 3 to the individual ribs 4.

The concave reflecting surfaces 25 and/or 30 shown in FIG. 4 may have a dual curvature (be "astigmatic") in the same manner as described above with reference to the concave reflecting surfaces 16 shown in FIG. 2 and 3.

As shown in FIG. 4, light from the central plane portion 23 of the output end 22 on the inner light conductor 13 may flow through the central cavity 35 in the hollow member 27 to the lower end of the top spike 12, the latter being made of transparent or translucent material and suitably adapted to radiate the light thus received from the inner light conductor 13.

In FIG. 4, both the top spike 12 and the end caps 11 are shown as consisting of translucent material, which is known to distribute light received in a diffuse manner. It should, however, be noted that these bodies may consist of transparent material with matt surfaces, this giving aproximately the same effect. For the sake of good order, it should also be mentioned that the term "light conductor" is used herein to denote a body of transparent material with an input end and an output end and with such a shape between these ends, that substantially total internal reflection occurs at the external surfaces between said ends.

FIGS. 5 and 6 show how the light from the electric light bulb 8 may be directed mainly towards the outer light conductor 14 (FIG. 5) or towards the inner light conductor 13 (FIG. 6). The change is effected by axially moving the light bulb 8 from the position shown in FIG. 5 to the position shown in FIG. 6, the light bulb 8 preferably being mechanically connected in a manner not shown to a focus button 36 on the handle 7 shown in FIG. 1. Thus by shifting the light bulb 8 from the position shown in FIG. 5 to the one shown in FIG. 6 it is possible to change the emphasis of the illumination from the non-central region of the cover 3 to the central region of this cover together with the rib caps 11 and the top spike 12. Instead of the single movable light bulb 8 shown in FIGS. 5 and 6, it is also possible to use two separate light bulbs adapted to be activated alternately or simultaneously.

FIGS. 2–6 make no pretence of showing geometrically exactly the shapes of the various optically active surfaces, suchs as those on the concave reflecting surfaces 16, 24 and 30, the input and output ends of the various light conductors, and the surfaces of the reflector 9 and the lens 10. A person with basic knowledge in optics will, however, be able to choose the correct shape of the surfaces in question and/or the material to be used.

Apart from the stick 2, the cover 3, the ribs 4, the struts 5 and the slide 6, the drawing does not show the mechanical parts of the umbrella 1 according to the present invention. On the basis of the present specification a skilled person will, however, be able to design and construct these mechanical parts in a suitable manner to enable them to fulfil their functions, but it may be mentioned that a metal tube 37 in the space between the inner and outer light conductors 13 and 14 respectively may be used to make the umbrella stick 2 sufficiently rigid. When assembling the umbrella care should be taken to orient the concave reflecting surfaces 16 shown in FIGS. 2 and 3 in such a manner relative to the axis 21 that the light reflected from these surfaces is not obstructed by the struts 5.

The handle 7 may comprise a translucent or transparent zone 38 that allows some of the light from the bulb 8 to radiate through this zone.

If desired, the rib caps 11, the top spike 12 and/or the zone 38 on the handle 7 may comprise fluorescent material, such as of the kind continuing to radiate light for some time when it is no longer being irradiated itself.

Instead of the top spike 12 it is possible to use a member comprising reflecting surfaces adapted to reflect light received through the central cavity 35 in a downward direction so as to illuminate the upper side of the cover 3. A combination of the two could also be used.

I claim:

1. An umbrella or parasol of the kind comprising:

a) a light source placed close to or in a handle of the umbrella or parasol, b) at least one elongated light conductor extending from an input end close to or adjacent said light source in the direction towards a cover of the umbrella or parasol, and c) at least one light-spreading means adapted to guide the light transmitted from said light source by said light conductor or conductors away from the latter, characterized by d) at least two light conductors, of which d1) a first light conductor extends to within a short distance below the cover and is adapted to direct light towards first light-spreading means situated close to and below said cover and adapted to direct light received from said first light conductor towards a central region of the inside of said cover, and d2) a second light conductor extends to a point at a greater distance below the cover and is adapted to direct light towards second light-spreading means adapted to direct light received from said second light conductor towards regions outside said central region of the inside of said cover.

2. An umbrella or parasol according to claim 1, characterized in a) that the two light conductors are coaxial with each other with the first within the second, and b) that at least one of the light conductors is adapted to direct light generally axially from its output end towards said light-spreading means which is in the form of a set of reflectors adapted to reflect the light generally radially outwards.

3. An umbrella or parasol according to claim 1, characterized by third light-spreading means situated between the cover and said first light-spreading means and adapted to direct light received from the latter towards inwardly facing input ends of a set of third light conductors, the outwardly facing output ends of which are situated close to an outer free edge of the cover and are optically connected to light-spreading means.

4. An umbrella or parasol according to claim 2, characterized in that the set of reflectors associated with the output end of the first light conductor consists of two sub-sets, viz.

a) a first sub-set in which the reflectors are distributed about an optical axis of the first light conductor with light-permeable interstices between them, and b) a second sub-set at a greater distance from said first light conductor than said first sub-set, and in which the reflectors are distributed about said optical axis and situated in positions to receive light reaching them from an output end of the first light conductor through said light-permeable interstices.

5. An umbrella or parasol according to claim 2, characterized in that each set of reflectors comprises a number of concave reflecting surfaces.

6. An umbrella or parasol according to claim 5, characterized in that at least some of said concave reflecting surfaces have such a focal width, that parallel rays from the output ends of the associated light conductors are made to cross each other at points lying a short distance from the reflecting surfaces.

7. An umbrella or parasol according to claim 6, characterized in that at least some of said concave reflecting surfaces have a dual curvature (are astigmatic) in such a manner, that said points of crossing appear closer to said optical axis when viewed in a direction parallel to said axis (e.g. FIG. 3) than when viewed at right angles to it (e.g. FIG. 4).

8. An umbrella or parasol according to claim 2, characterized by a top light-spreading means extending above the cover said top light-spreading means being adapted to receive light from the output end of said first light conductor, e.g. through a central hole in a member carrying the reflecting surfaces associated with the first light conductor.

9. An umbrella or parasol according to claim 2, characterized in that connecting means optically connecting the light source to input ends of the light conductors at least partially consists of transparent or translucent material in such a manner, that light from the light source may emanate from its external surface between the light source and said input ends.

10. An umbrella or parasol according to claim 1, characterized in that the light source comprises a light bulb and a collecting lens placed between said light bulb and input ends of said light conductors, the distance between said light bulb and said collecting lens along the latters' optical axis being adjustable by means of a manual control member in such a manner, that the light from said lens strikes the input end of either of the light conductors.

* * * * *